US010842200B2

(12) United States Patent
Colon

(10) Patent No.: US 10,842,200 B2
(45) Date of Patent: Nov. 24, 2020

(54) REMOVABLE STIFFENER ELEMENTS FOR AN OPEN COLLARED SHIRT

(71) Applicant: Modesto Colon, Orlando, FL (US)

(72) Inventor: Modesto Colon, Orlando, FL (US)

( * ) Notice: Subject to any disclaimer, the term of this patent is extended or adjusted under 35 U.S.C. 154(b) by 166 days.

(21) Appl. No.: 15/933,525

(22) Filed: Mar. 23, 2018

(65) Prior Publication Data

US 2018/0271175 A1 Sep. 27, 2018

Related U.S. Application Data

(60) Provisional application No. 62/475,387, filed on Mar. 23, 2017.

(51) Int. Cl.
*A41B 1/20* (2006.01)
*A41B 1/02* (2006.01)

(52) U.S. Cl.
CPC . *A41B 1/20* (2013.01); *A41B 1/02* (2013.01)

(58) Field of Classification Search
CPC ..... A41B 1/20; A41B 1/02
See application file for complete search history.

(56) References Cited

U.S. PATENT DOCUMENTS 2,163,654 A 6/1939 Ziegler
2,595,112 A 4/1952 Story
2,599,636 A * 6/1952 Hull ..... A41B 3/06 2/132
5,769,287 A 6/1998 Kim
8,001,619 B1 * 8/2011 Baehring ..... A41B 3/08 2/132
9,204,671 B1 12/2015 Kessler, III
2002/0113099 A1 8/2002 Kim
2007/0044198 A1 * 3/2007 Whicker ..... A41F 1/00 2/69
2008/0010883 A1 * 1/2008 Morgese ..... G09F 3/203 40/654.01
2014/0173809 A1 * 6/2014 Partsch, IV ..... A41B 1/20 2/255
2016/0088876 A1 3/2016 Davis
2016/0100634 A1 * 4/2016 Rogers ..... A41B 1/02 2/256

* cited by examiner

*Primary Examiner* — Khaled Annis
(74) *Attorney, Agent, or Firm* — Allen, Dyer, Doppelt + Gilchrist, PA

(57) ABSTRACT

A stiffener assembly for a shirt with an open collar includes a pair of stiffener pockets, and a pair of removable stiffener inserts to be inserted into the pair of stiffener pockets to hold the open collar of the shirt in a desired shape. Each stiffener pocket includes an outer pocket panel, and an inner pocket panel aligned with the outer pocket panel. The outer and inner pocket panels each have a top, a bottom and sides extending between the top and bottom. Stitching couples together the outer and inner pocket panels along the sides and bottom thereof so as to form a passageway extending between the outer and inner pockets panel. The top of the outer and inner pocket panels are not stitched so as to form a stiffener pocket opening. The removable stiffener inserts are inserted into the passageways of the stiffener pockets through the stiffener pocket openings.

9 Claims, 12 Drawing Sheets

REMOVABLE STIFFENER ELEMENTS FOR AN OPEN COLLARED SHIRT

RELATED APPLICATION

This application claims the benefit of provisional application Ser. No. 62/475,387 filed Mar. 23, 2017, which is hereby incorporated herein in its entirety by reference.

FIELD OF THE INVENTION

The present invention relates to the field of garments, such as shirts, and more particularly, to removable stiffener elements for an open collared shirt.

BACKGROUND OF THE INVENTION

A shirt typically includes a collar, a back body section extending from the collar, and a front body section extending from the collar and secured to the back body section. Respective sleeves are secured to the back and front body sections. For a button-down dress shirt, the front body section is divided into adjacent panels.

The adjacent panels are typically held together using buttons or snaps. It is common to leave the upper buttons or snaps unfastened to provide an open collar appearance. However, it is also common for the open upper area of the shirt to crumple or buckle under the weight of the collar, which can provide an unattractive and rumpled appearance.

Starch may be used to stiffen portions of the shirt. Unfortunately, the effects of the starch can dissipate over time. In addition, overly starched areas of the open collared shirt can be uncomfortable.

Another approach for preventing the open upper area of the shirt from crumpling or buckling under the weight of the collar is disclosed in U.S. Pat. No. 9,204,671. The '671 patent discloses a placket stiffener arrangement for an open collared shirt. The shirt includes a closed passage in each front panel adjacent an edge area of the front panel, and extends downwardly from the upper edge area of the front panel. A non-removable stiffener member is contained within each closed passage, and extends into the upper neck area of the front panel and downwardly therefrom within the closed passage to maintain an open collar appearance. Even in view of the above placket stiffener arrangement, there is still a need to improve how the upper portions of an open collared shirt may be held open in a desired shape.

SUMMARY

A shirt comprises a collar, a back section extending from the collar, and a front section extending from the collar and secured to the back section. At least an upper portion of the front section that is adjacent the collar is divided into a pair of edge areas. A pair of stiffener pockets is carried by the pair of edge areas, with each stiffener pocket having a stiffener pocket opening. A pair of removable stiffener inserts is inserted into the pair of stiffener pockets through the respective stiffener pocket openings to hold the upper portion of the front body section in a desired shape while the pair of edge areas are spaced apart from one another.

An advantage of the removable stiffener inserts is that they can be removed from the stiffener pockets before the shirt is washed. This avoids the stiffener inserts from losing their stiffness over time after repeated washings. Alternatively, if the stiffener inserts start to lose their stiffness, then they may be easily replaced with new ones. Moreover, if the person wearing the shirt decides to button the upper portion of the front body section, such as when wearing a tie, then the stiffener inserts may be removed so that the shirt may be more comfortable with a closed collar.

In one embodiment, each stiffener pocket comprises an outer pocket panel having a top, a bottom and sides extending between the top and bottom, and an inner pocket panel aligned with the outer pocket panel. The inner pocket panel has a top, a bottom and sides extending between the top and bottom. Stitching couples together the outer and inner pocket panels along the sides and bottom so as to form a passageway extending between the outer and inner pocket panels for one of the removable stiffener pocket inserts. The top of the outer and inner pocket panels are not stitched so as to form the stiffener pocket opening.

In another embodiment, each edge area has an outer facing surface and an inner facing surface opposite the outer facing surface, and each stiffener pocket comprises an outer pocket panel having a top, a bottom and sides extending between the top and bottom. Stitching couples the sides and bottom of the outer pocket panel to the inner facing surface of the edge area so as to form a passageway extending between the outer pocket panel and the inner facing surface for one of the removable stiffener pocket inserts. The top of the outer pocket panel is not stitched to the inner facing surface so as to form the stiffener pocket opening.

In yet another embodiment, each edge area comprises a layered edge area comprising an outer layer and an inner layer aligned with the outer layer, and with each stiffener pocket between the outer and inner layers and forming a passageway therebetween for one of the removable stiffener pocket inserts. The inner layer includes an opening that aligns with the stiffener pocket opening. Stitching is between the outer and inner layers forming the stiffener pocket.

In one embodiment, the shirt may further comprise respective adhesive layers to secure the pair of stiffener pockets to the pair of edge areas. In another embodiment, the shirt may further comprise respective stitching to secure the pair of stiffener pockets to the pair of edge areas.

Each stiffener pocket may have a color and/or pattern that matches a color and/or pattern of the front section of the shirt. Each edge area has an outer facing surface and an inner facing surface opposite the outer facing surface, and each respective stiffener pocket is on the inner facing surface.

Each stiffener element comprises a semi-rigid flexible material that maintains a desired shape over time. Each stiffener element may have a rectangular shape with at least one curved tip.

Each stiffener pocket may have a length within a range of about 6 to 8 inches for a shirt where the edge areas extend along the entire front section, as in a dress shirt. Alternatively, each stiffener pocket may have a length within a range of about 2 to 4 inches for a shirt where the edge areas only partially extend along the entire front section, as in a pull-over shirt.

Another aspect is directed to a stiffener assembly for a shirt with an open collar comprising a pair of stiffener pockets. Each stiffener pocket comprises an outer pocket panel and an inner pocket panel. The outer pocket panel has a top, a bottom and sides extending between the top and bottom. The inner pocket panel is aligned with the outer pocket panel and has a top, a bottom and sides extending between the top and bottom. Stitching couples together the outer and inner pocket panels along the sides and bottom so as to form a passageway extending between the outer and inner pocket panels. The top of the outer and inner pocket panels are not stitched so as to form a stiffener pocket opening for the passageway. A pair of removable stiffener inserts is to be inserted into the passageways of the pair of stiffener pockets through the respective stiffener pocket openings to hold the open collar of the shirt in a desired shape.

Yet another aspect is directed to a stiffener assembly for a tie comprising a stiffener pocket as described above to be secured to the tie, and a removable stiffener insert to be inserted into the stiffener pocket to hold a portion of the tie in a desired shape.

Yet another aspect is directed to a pocket handkerchief comprising a rectangular-shaped handkerchief panel having a top, a bottom and sides extending between the top and bottom, and with the handkerchief panel having a fold along each of the sides. Stitching is within the fold adjacent each of the sides of the handkerchief panel so as to form respective passageways extending within the fold. A pair of removable stiffener inserts is to be inserted into the respective passageways to hold the pocket handkerchief in a desired shape.

DETAILED DESCRIPTION OF THE PREFERRED EMBODIMENTS

Figure 1:
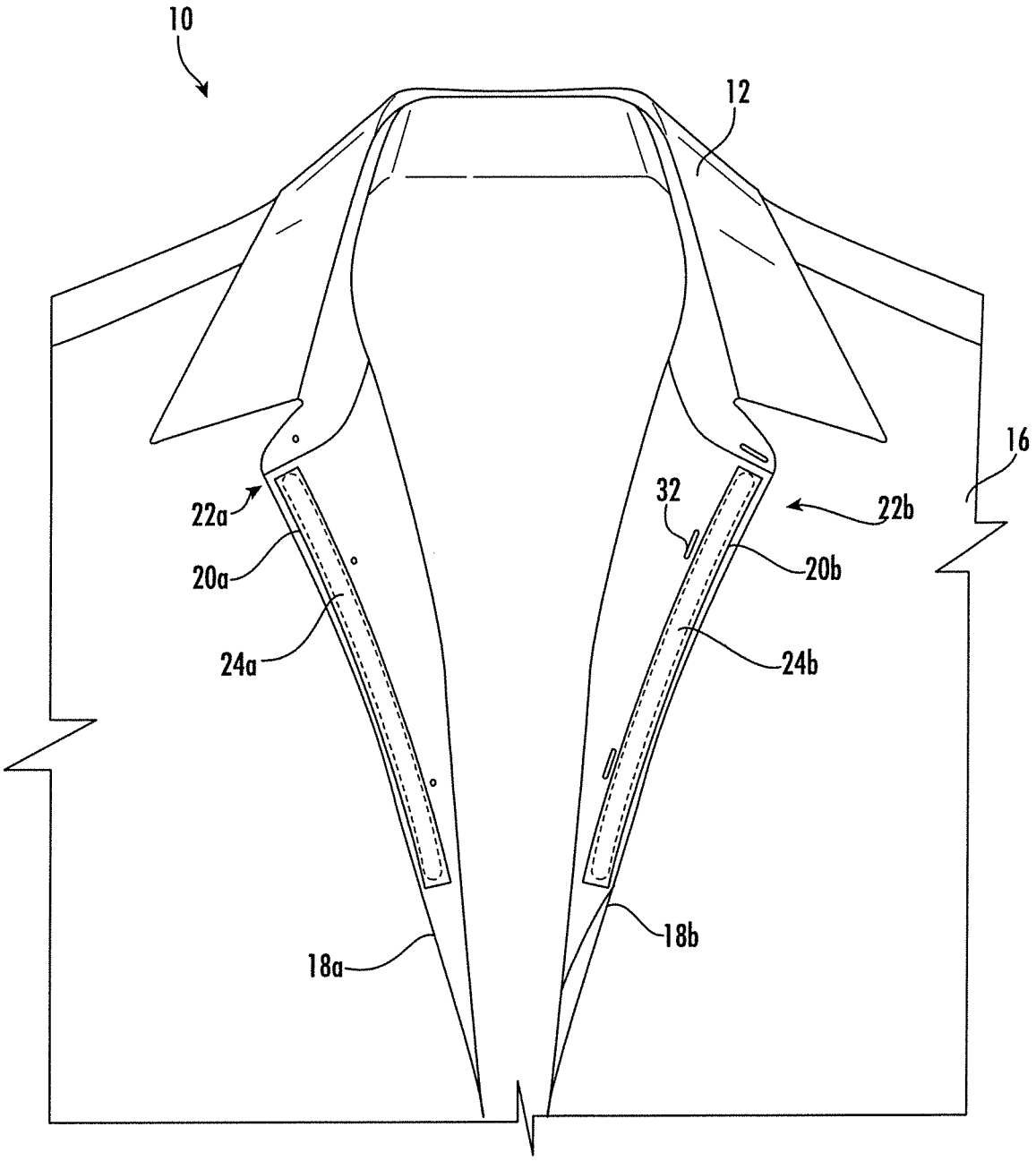
FIG. 1 is a front view of a shirt with stiffener elements in accordance with the present invention.
Figure 2:
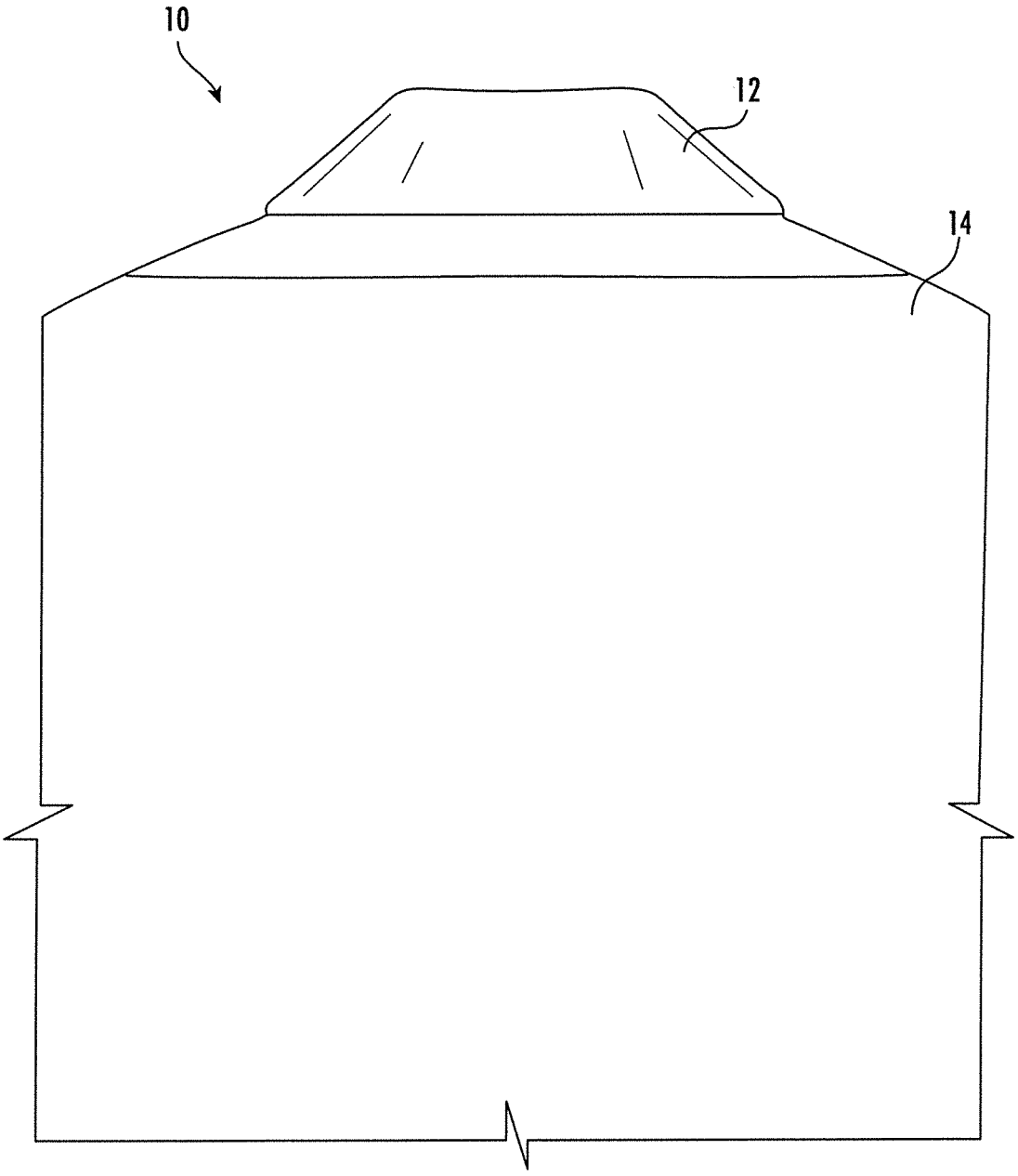
FIG. 2 is a rear view of the shirt illustrated in FIG. 1.
Figure 3:
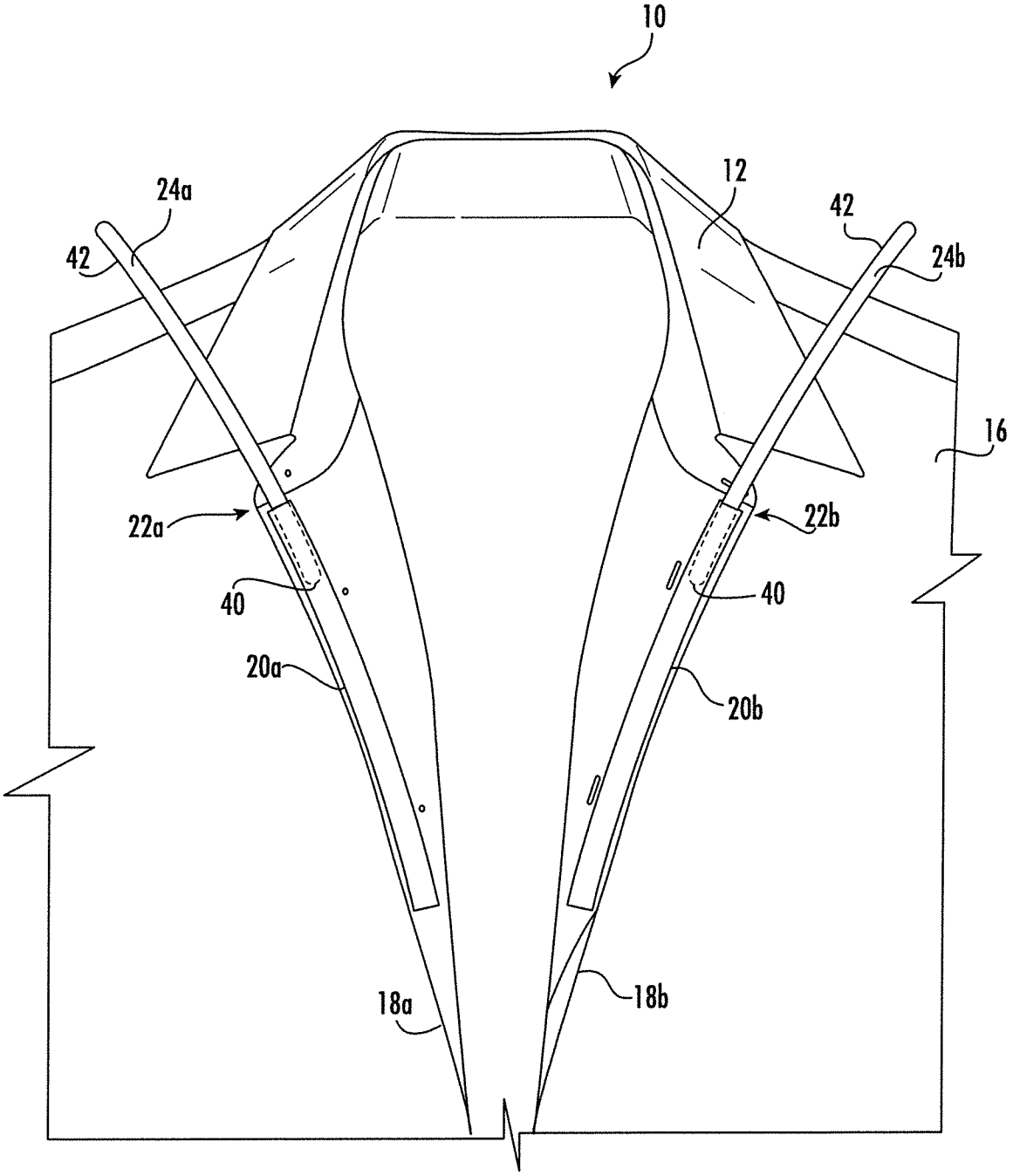
FIG. 3 is a front view of the shirt illustrated in FIG. 1 with the stiffener elements partially inserted into their respective stiffener pocket.
Figure 4:
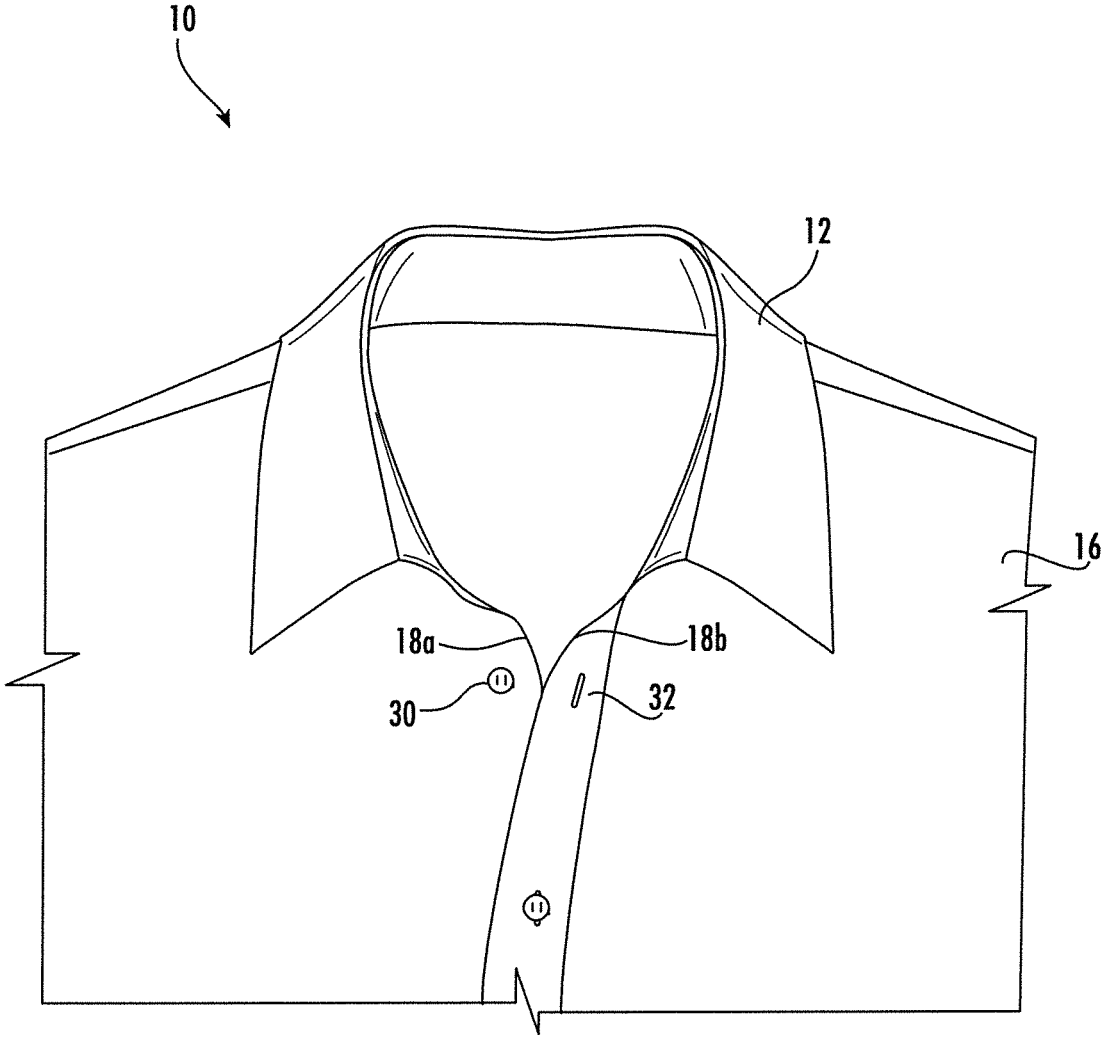
FIG. 4 is a front view of the shirt illustrated in FIG. 1 buttoned except for the open area near the collar.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notations are used to indicate similar elements in alternative embodiments.

Referring now to FIGS. 1-5, a shirt 10 to be worn by a user includes a collar 12, a back body section 14 extending from the collar, and a front body section 16 extending from the collar and secured to the back body section. Respective sleeves are secured to the back and front body sections 14, 16. At least an upper portion of the front body section 16 adjacent the collar 12 is divided into a pair of edge areas 18*a*, 18*b*.

A pair of stiffener pockets 20*a*, 20*b* is carried by the pair of edge areas 18*a*, 18*b*. Each stiffener pocket 20*a*, 20*b* includes a pocket opening 22*a*, 22*b* facing the collar 12. A pair of removable stiffener inserts 24*a*, 24*b* is inserted into the pair of stiffener pockets 20*a*, 20*b* through the respective pocket openings 22*a*, 22*b* to hold the upper portion of the front body section 16 in a desired shape while the pair of edge areas 18*a*, 18*b* are spaced apart from each other.

An advantage of the stiffener inserts 24*a*, 24*b* being removable is that they can be removed from their respective pocket opening 22*a*, 22*b* before the shirt 10 is washed. This avoids the stiffener inserts 24*a*, 24*b* from losing their stiffness over time after repeated washings. Alternatively, if the stiffener inserts 24*a*, 24*b* start to lose their stiffness, then they may be easily replaced with new ones. Moreover, if the user decides to button the upper portion of the front body section 16, such as when wearing a tie, then the stiffener inserts 24*a*, 24*b* may be removed so that the shirt 10 may be more comfortable with a closed collar.

In the illustrated shirt 10, the front body section 16 is completely divided so that the shirt can be completely open in the front. In this example, the shirt 10 is a button-down dress shirt.

The edge areas 18*a*, 18*b* of the shirt 10 may also be referred to as plackets. When worn by the user, the edge areas 18*a*, 18*b* are secured to one another in an overlapping manner. Edge area 18*a* includes a plurality of spaced apart buttons 30, and edge area 18*b* includes a plurality of spaced apart button holes 30. The buttons 30 may be selectively inserted into the button holes 32 depending on how the user would like to wear the shirt. As an alternative to buttons 30, snaps or clips may be used.

In the illustrated shirt 10, the respective stiffener pockets 20*a*, 20*b* do not overlap or interfere with the buttons 30 or button holes 32. Stiffener pocket 20*a* is positioned between the buttons 30 and the outermost edge of edge area 18*a*. Similarly, stiffener pocket 20*b* is positioned between the button holes 32 and the outermost edge of edge area 18*b*.

The stiffener pockets 20*a*, 20*b* do not extend the full length of the edge areas 18*a*, 18*b*. Instead, the stiffener pockets 20*a*, 20*b* are limited to the upper portion of the front body section 16 since the user is concerned with the appearance of the shirt 10 when wearing an open collar.

A length of the stiffener pockets 20*a*, 20*b* depends on the size of the shirt. A typical length is within 6 to 8 inches, for example. A corresponding length of the stiffener inserts 24*a*, 24*b* is slightly less so as not to be exposed when in their respective stiffener pockets 20*a*, 20*b*.

The stiffener pockets 20*a*, 20*b* may be referred to as external pockets since they are added to the shirt 10 after the shirt has been made. Each stiffener pocket 20*a*, 20*b* is secured on the inside of the front panel 16 at the edge areas 18*a*, 18*b*. Each stiffener pocket 20*a*, 20*b* is secured on the inside of the front panel 16 at the edge areas 18*a*, 18*b* such that portions of inside the front panel 16 are used as a backing for each respective stiffener pocket 20*a*, 20*b*. Alternatively, each stiffener pocket 20*a*, 20*b* includes its own backing.

Stitching 90 may be used to secure the sides and bottom of each stiffener pocket 20*a*, 20*b* on the inside of the front panel 16. The stitching 90 is illustrated on a stiffener pocket 20 in FIG. 8. Alternatively, an iron on type adhesive 81 may be used to secure the stiffener pockets 20*a*, 20*b* on the inside of the front panel 16. The adhesive layer 81 is illustrated on the inner pocket panel 80 in FIG. 7.

The stiffener pockets 20*a*, 20*b* may be partially visible when worn by the user. The fabric and stitching used for the stiffener pockets 20*a*, 20*b* may be selected to match the color and/or pattern of the shirt 10. Alternatively, the fabric and stitching used for the stiffener pockets 20*a*, 20*b* may be selected to provide a contrasting color and/or pattern of the shirt 10 so as to compliment the shirt.

In another embodiment, the stiffener pockets 20*a*, 20*b* may be referred to as internal pockets since they are added when the shirt 10 is made. The edge areas 18*a*, 18*b* of the shirt 10 typically consist of folded over or reinforced material forming the placket. The folded over or reinforced material increases a thickness of the edge areas 18*a*, 18*b* of the shirt 10. This allows extra stitching to be added to form the sides and bottom of the stiffener pockets 20*a*, 20*b*.

Portions of the folded over or reinforced material of the front panel 16 are thus used as a back and front for each respective stiffener pocket 20*a*, 20*b*. Openings are provided in the inside of the front panel 16 to form the pocket openings 22*a*, 22*b* for the respective stiffener pockets 20*a*, 20*b*.

The stiffener inserts 24*a*, 24*b* have a generally flat, planar configuration. The tip 40 of each stiffener insert 24*a*, 24*b* may be angled or curved to allow easier insertion into the pocket opening 22*a*, 22*b*. The other end 42 of the each stiffener insert 24*a*, 24*b* may also be angled or curved to allow easier removal from the pocket opening 22*a*, 22*b*.

Each stiffener insert 24*a*, 24*b* is formed from a thin, rigid or semi-rigid material that maintains its shape over time. The material used for the stiffener inserts 24*a*, 24*b* includes fiber, plastic or metals that may be twisted and/or bent by the user to retain a desired shape.

Figure 5:
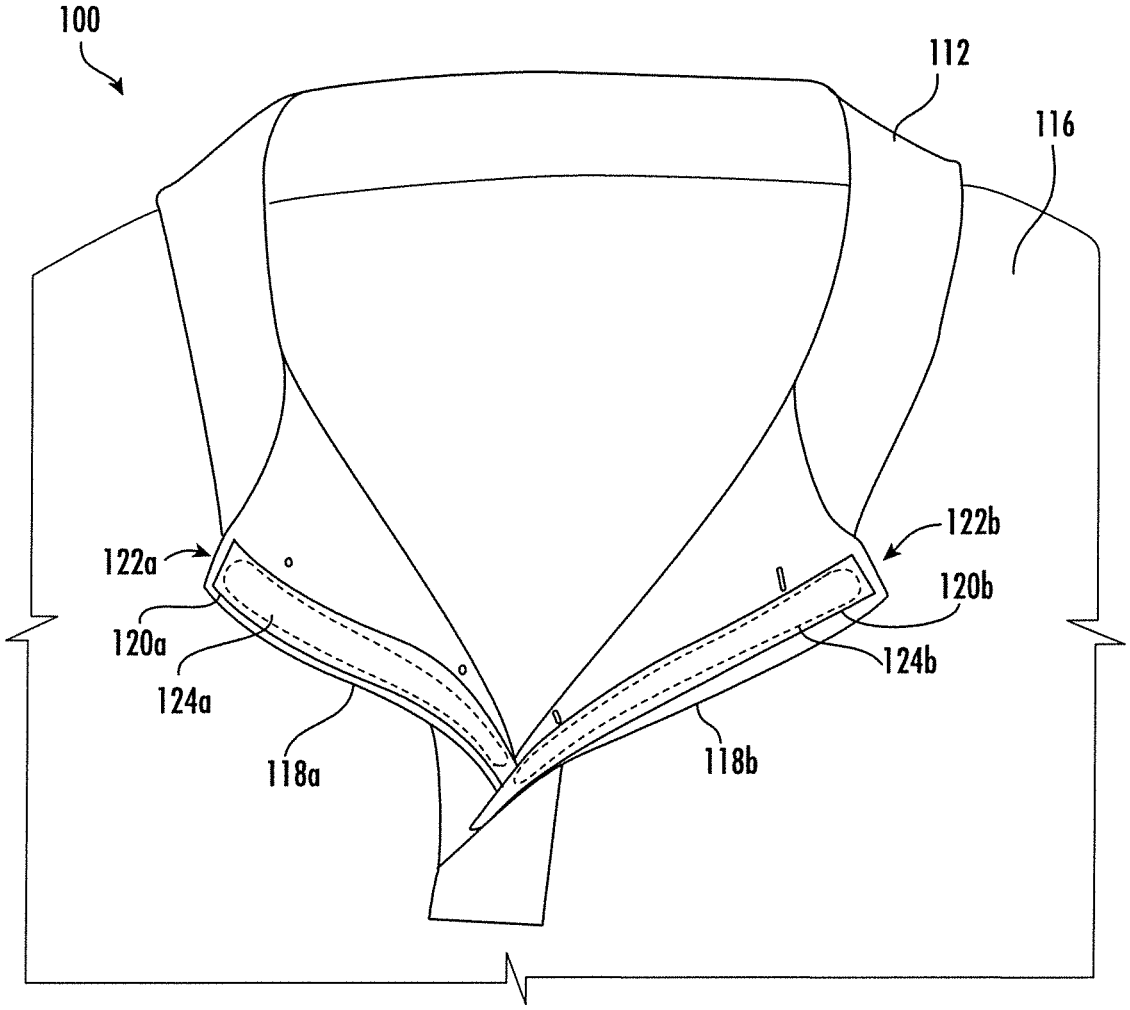
FIG. 5 is a front view of a pull-over shirt with stiffener elements in accordance with the present invention.

Stiffener inserts 124*a*, 124*b* may also be used with a pullover shirt, such as a collared polo type shirt 100 illustrated in FIG. 5. As with the dress shirt 10 discussed above, the pullover shirt 100 includes a collar 112, a back body section extending from the collar, and a front body section 116 extending from the collar and secured to the back body section. Respective sleeves are secured to the back and front body sections. An upper portion of the front body section 116 adjacent the collar 112 is divided into a pair of edge areas 118*a*, 118*b*.

A pair of stiffener pockets 120*a*, 120*b* is carried by the pair of edge areas 118*a*, 118*b*. Each stiffener pocket 120*a*, 120*b* includes a pocket opening 122*a*, 122*b* facing the collar 112. A pair of removable stiffener inserts 124*a*, 124*b* is inserted into the pair of stiffener pockets 120*a*, 120*b* through the respective pocket openings 122*a*, 122*b* to hold the upper portion of the front body section 116 in a desired shape while the pair of edge areas 118*a*, 118*b* are spaced apart from each other. The stiffener pockets 120*a*, 120*b* may be external or internal to the shirt 100, as discussed above.

The stiffener pockets 20*a*, 20*b* will now be discussed in greater detail with reference to FIGS. 6-12, and may be generally referred to as a stiffener pocket 20. The stiffener inserts 24*a*, 24*b* may be generally referred to as a stiffener insert 24. The pocket opening 22*a*, 22*b* may be generally referred to as a pocket opening 22. The edge areas 18*a*, 18*b* may be generally referred to as an edge area 18.

Figure 6:
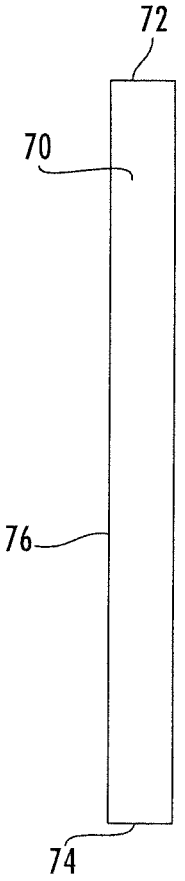
FIGS. 6-8 are unassembled views and an assembled view of one embodiment of the stiffener pocket illustrated in FIG. 1.
Figure 7:
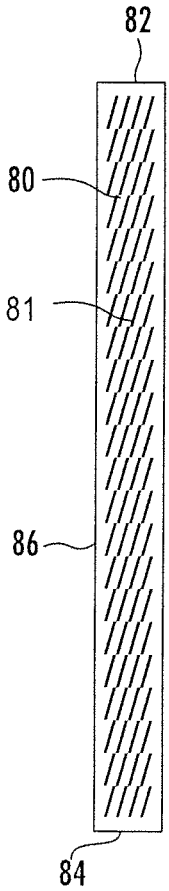
Figure 8:
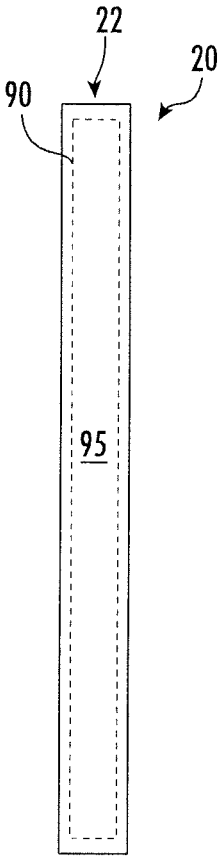

In one embodiment, as illustrated in FIGS. 6-8, each stiffener pocket 20 includes an outer pocket panel 70 having a top 72, a bottom 74 and sides 76 extending between the top and bottom, and an inner pocket panel 80 is aligned with the outer pocket panel 70. The inner pocket panel 80 has a top 82, a bottom 84 and sides 86 extending between the top and bottom. Stitching 90 couples together the outer and inner pocket panels 70, 80 along the sides 76, 86 and bottom 74, 84 so as to form a passageway 95 extending between the outer and inner pocket panels 70, 80 for one of the removable stiffener pocket inserts 24. The top 72, 82 of the outer and inner pocket panels 70, 80 are not stitched so as to form the stiffener pocket opening 22.

Figure 9:
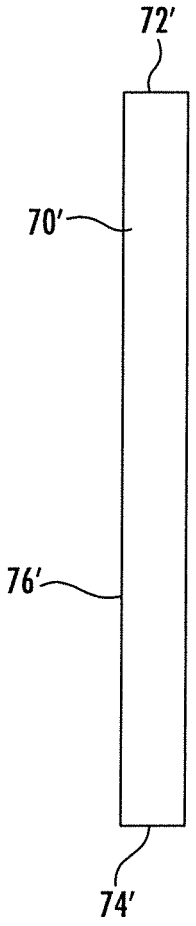
FIGS. 9-10 are an unassembled view and an assembled view of another embodiment of the stiffener pocket illustrated in FIG. 1.
Figure 10:
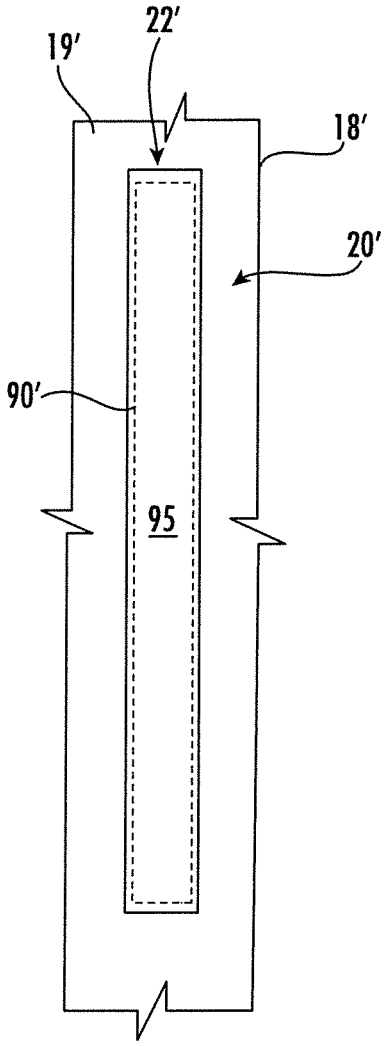

In another embodiment, as illustrated in FIGS. 9-10, each edge area 18' has an outer facing surface and an inner facing surface 19' opposite the outer facing surface, and each stiffener pocket 20' includes an outer pocket panel 70' having a top 72', a bottom 74' and sides 76' extending between the top and bottom. Stitching 90' couples the sides 76' and bottom 74' of the outer pocket panel 70' to the inner facing surface 19' of the edge area 18' so as to form a passageway 95' extending between the outer pocket panel 70' and the inner facing surface 19' of the edge area 18' for one of the removable stiffener pocket inserts 24'. The top 72' of the outer pocket panel 70' is not stitched to the inner facing surface 19' of the edge area 18' so as to form the stiffener pocket opening 22'.

Figure 11:
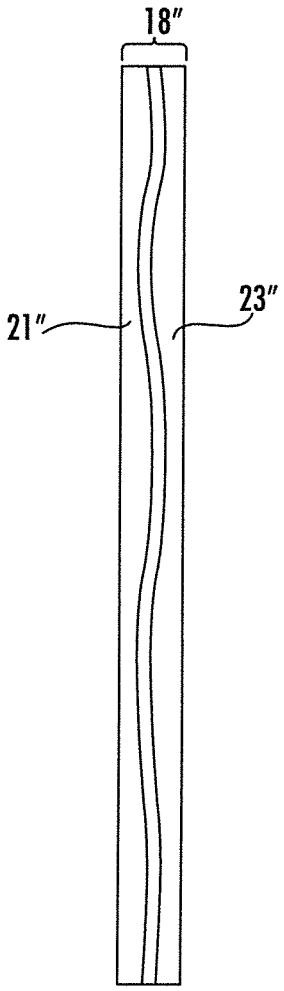
FIGS. 11-12 are an unassembled view and an assembled view of yet another embodiment of the stiffener pocket illustrated in FIG. 1.
Figure 12:
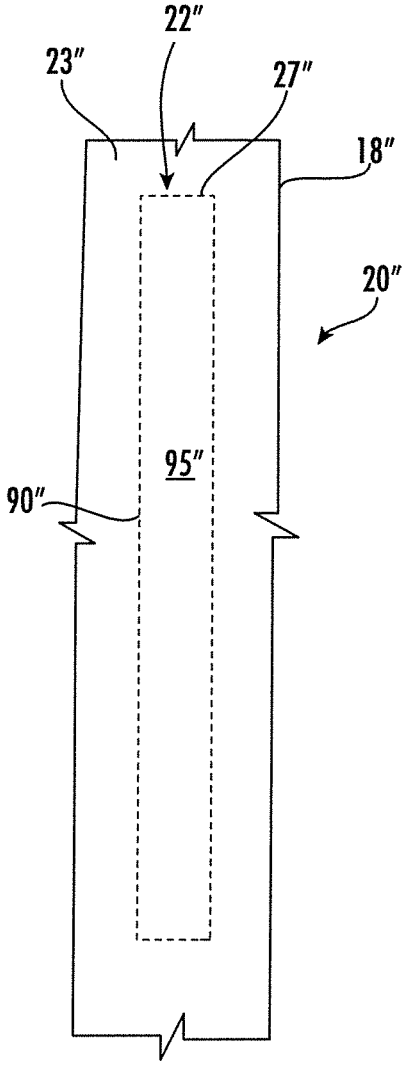

In yet another embodiment, as illustrated in FIGS. 11-12, each edge area 18" includes a layered edge area comprising an outer layer 21" and an inner layer 23" aligned with the outer layer, and each stiffener pocket 20" is between the outer and inner layers 21", 23" and forms a passageway 95" therebetween for one of the removable stiffener pocket inserts 24". There is separation between the outer and inner layers 21", 23". The inner layer 23" includes an opening 27" that aligns with the stiffener pocket opening 22". Stitching 90" is between the outer and inner layers 21", 23" so as to internally form the stiffener pocket 20".

The concept of the above described stiffener inserts is not limited to shirts. Stiffener inserts may be used on other types of garments, such as ties 150 and pocket handkerchiefs 200, as illustrated in FIGS. 13-16.

Figure 13:
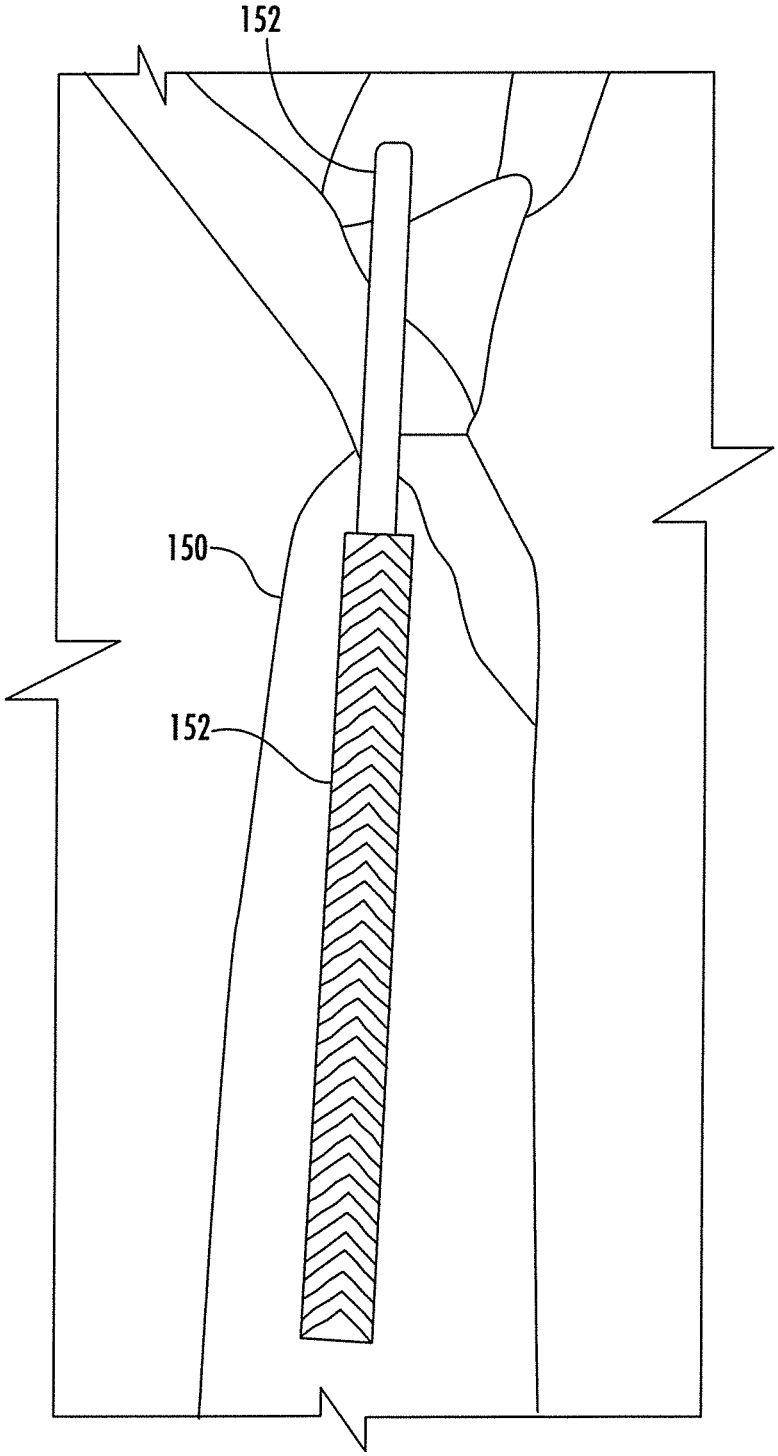
FIG. 13 is a back view of a tie with a stiffener element in accordance with the present invention.

A stiffener pocket 152, as described above, may be added to the backside of a tie 150, and a removable stiffener insert 152 is inserted into the stiffener pocket, as illustrated in FIG. 13. The stiffener insert 152 advantageously helps the tie 150 to have a clean and neat appearance when worn by a user. The stiffener pocket 152 may be internally or externally carried by the tie 150.

Figure 14:
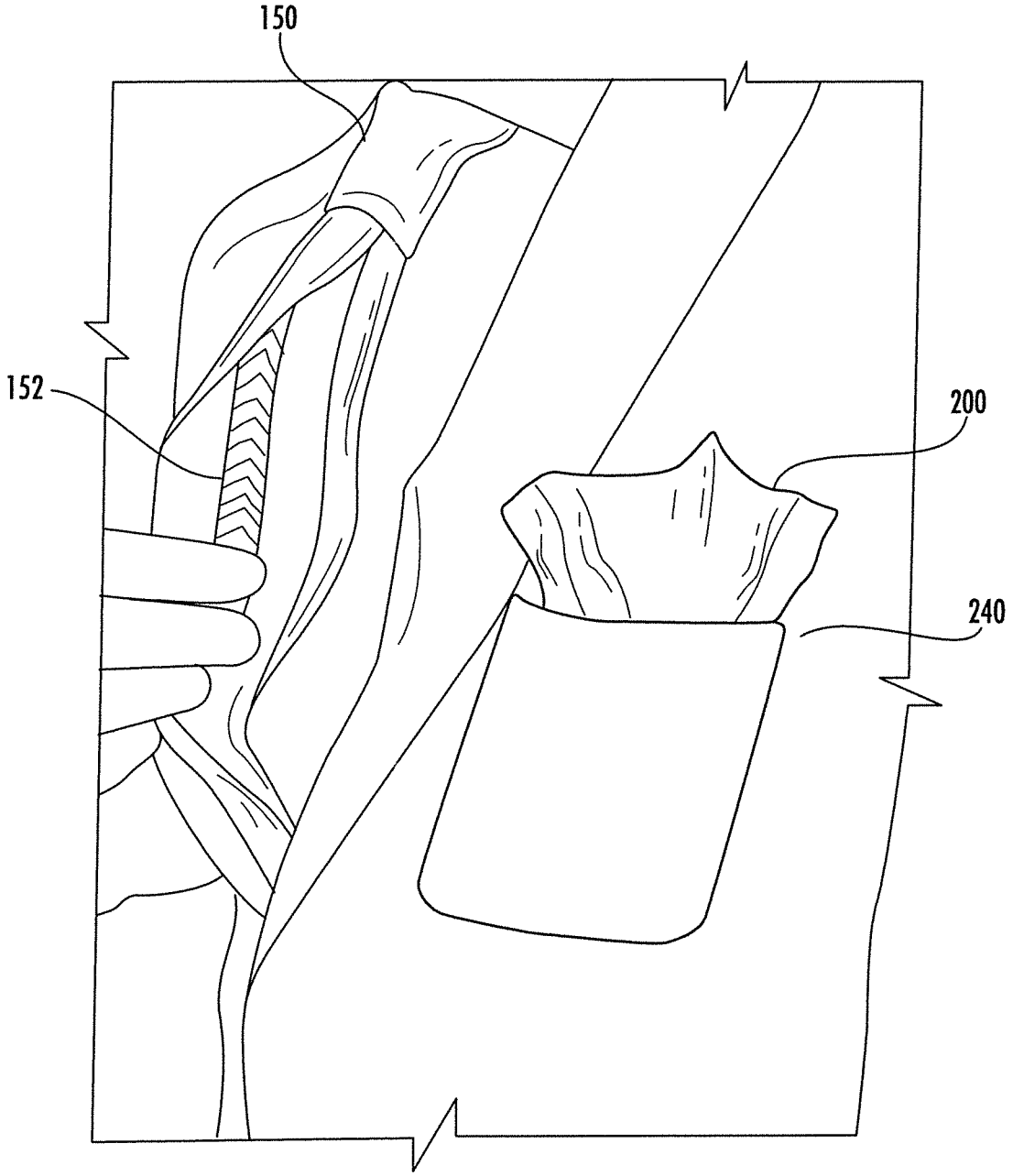
FIGS. 14-16 are views of a pocket scarf with stiffener elements in accordance with the present invention.
Figure 15:
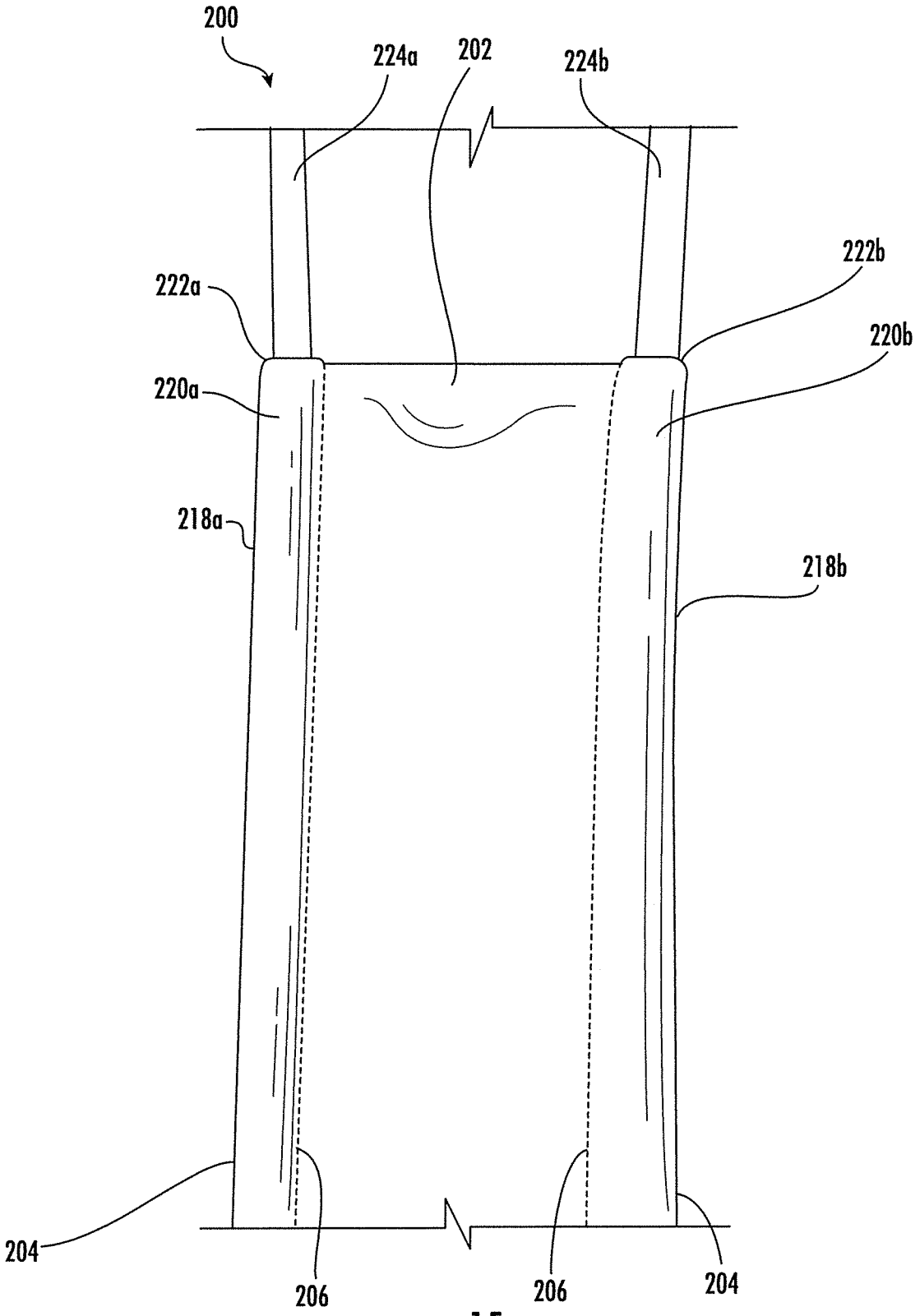
Figure 16:
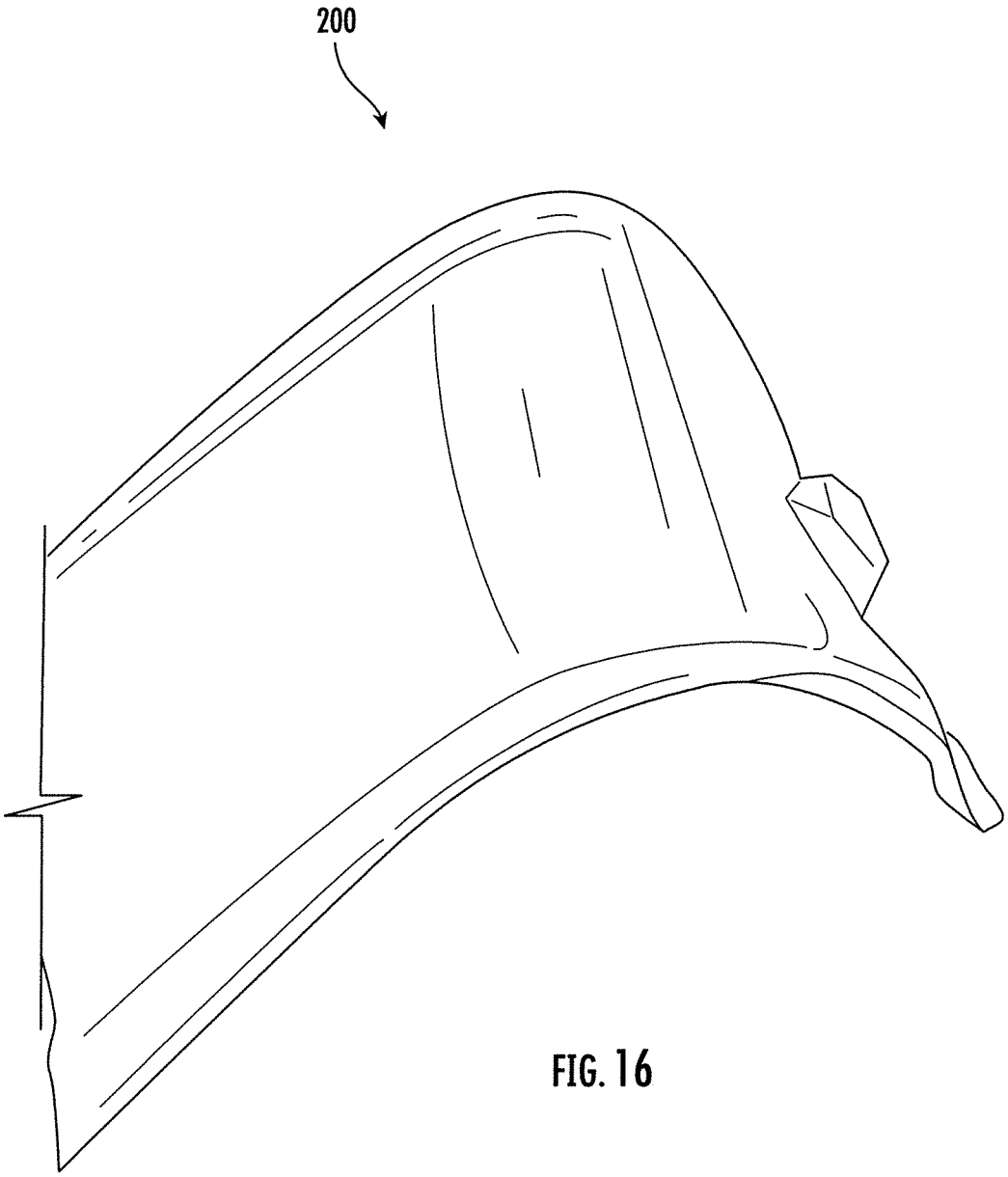

The illustrated pocket handkerchief 200 in FIGS. 14-16 includes a pair of stiffener pockets 220*a*, 220*b* carried by the outer edge areas 218*a*, 218*b* of the handkerchief. Each stiffener pocket 220*a*, 220*b* includes at least one pocket opening 222*a*, 222*b*. Typically, both ends of the stiffener pockets 220*a*, 220*b* will be open. A pair of removable stiffener inserts 224*a*, 224*b* is inserted into the pair of stiffener pockets 220*a*, 220*b* through respective pocket openings 222*a*, 222*b*. The stiffener pockets 120*a*, 120*b* may be external or internal to the handkerchief 200, as discussed above. The pocket handkerchief 200 is folded over prior to placing in a suit jacket pocket 240 with the removable stiffener inserts 224*a*, 224*b* in place so as to advantageously hold the handkerchief in a desired position to give a clean and neat appearance when worn by a user.

More particularly, the pocket handkerchief 200 may include a rectangular-shaped handkerchief panel 202 having a top, a bottom and sides extending between the top and bottom, and with the handkerchief panel 202 having a fold 204 along each of the sides. Stitching 206 is within the fold 204 adjacent each of the sides of the handkerchief panel 202 so as to form respective passageways 222*a*, 222*b* extending within the fold 204. A pair of removable stiffener inserts

224*a*, 224*b* is to be inserted into the respective passageways 222*a*, 222*b* to hold the pocket handkerchief 200 in a desired shape.

Yet another aspect is directed to a stiffener assembly for a shirt with an open collar comprising pair of stiffener pockets as described above in reference to FIGS. 6-8, and a pair of removable stiffener inserts that are to be inserted into the pair of stiffener pockets to hold the open collar of the shirt in a desired shape. Similar, the stiffener assembly may be adapted for a tie by including a single stiffener pocket and a single removable stiffener insert.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included.

That which is claimed:

1. A shirt comprising:

a collar;

a back section extending from said collar;

a front section extending from said collar and secured to said back section, and at least an upper portion of said front section that is adjacent said collar is divided into a pair of edge areas, with the pair of edge areas including at least one button and at least one button opening aligned with the at least one button;

a pair of stiffener pockets carried by the pair of edge areas and non-overlapping with the least one button and the at least one button opening, and with each stiffener pocket having a stiffener pocket opening; and a pair of removable stiffener inserts inserted into said pair of stiffener pockets through the respective stiffener pocket openings, with each removable stiffener insert devoid of any openings.

2. The shirt according to claim 1 wherein each stiffener pocket comprises:

an outer pocket panel having a top, a bottom and sides extending between the top and bottom;

an inner pocket panel aligned with said outer pocket panel and having a top, a bottom and sides extending between the top and bottom; and stitching to couple together said outer and inner pocket panels along the sides and bottom so as to form a passageway extending between said outer and inner pocket panels for one of said removable stiffener pocket inserts, and with the top of said outer and inner pocket panels not being stitched so as to form the stiffener pocket opening.

3. The shirt according to claim 1 further comprising respective adhesive layers to secure said pair of stiffener pockets to said pair of edge areas.

4. The shirt according to claim 1 further comprising respective stitching to secure said pair of stiffener pockets to said pair of edge areas.

5. The shirt according to claim 1 wherein each stiffener pocket has at least one of a color and pattern that matches at least one of a color and pattern of said front section.

6. The shirt according to claim 1 wherein each edge area has an outer facing surface and an inner facing surface opposite the outer facing surface, and wherein each respective stiffener pocket is on the inner facing surface.

7. The shirt according to claim 1 wherein each stiffener insert has a rectangular shape with at least one curved tip.

8. The shirt according to claim 1 wherein each stiffener pocket has a length within a range of about 6 to 8 inches.

9. The shirt according to claim 1 wherein each stiffener pocket has a length within a range of about 2 to 4 inches.

* * * * *